US006652272B2

(12) United States Patent
Schilling et al.

(10) Patent No.: US 6,652,272 B2
(45) Date of Patent: Nov. 25, 2003

(54) DEVICE FOR SLUICING A HOT MEAL-FORM MATERIAL

(75) Inventors: Horst Schilling, Köln (DE); Ralf Filges, Bergisch Gladbach (DE)

(73) Assignee: KHD Humboldt Wedag AG, Köln (DE)

( * ) Notice: Subject to any disclaimer, the term of this patent is extended or adjusted under 35 U.S.C. 154(b) by 0 days.

(21) Appl. No.: 10/339,967

(22) Filed: Jan. 10, 2003

(65) Prior Publication Data

US 2003/0134248 A1 Jul. 17, 2003

(30) Foreign Application Priority Data

Jan. 12, 2002 (DE) ..... 102 00 960

(51) Int. Cl.[7] ..... F27B 15/09
(52) U.S. Cl. ..... 432/58; 432/95; 110/163
(58) Field of Search ..... 432/97, 98, 235, 432/58, 14, 17, 95; 110/163

(56) References Cited

U.S. PATENT DOCUMENTS 3,693,812 A * 9/1972 Mahr et al. ..... 414/148
4,708,643 A * 11/1987 Nagl et al. ..... 432/95
4,971,228 A * 11/1990 Baker et al. ..... 222/491
5,046,908 A * 9/1991 Cimenti et al. ..... 414/203
5,115,578 A * 5/1992 Basten ..... 34/576
5,577,863 A * 11/1996 Nottle ..... 405/87
5,595,482 A * 1/1997 Parsons ..... 432/95
6,000,937 A 12/1999 Schilling et al.
6,444,026 B1 9/2002 Steffler et al.

OTHER PUBLICATIONS

Drehrohrofenanlagen, rotary kiln plants No. 8–100d of KHD Humboldt Wedag AG, 5–84, pp. 8 and 9.

* cited by examiner

*Primary Examiner*—Gregory Wilson
(74) *Attorney, Agent, or Firm*—Sonnenschein Nath & Rosenthal

(57) ABSTRACT

In order to create a device like a shuttle sluice for sluicing or distributing a hot meal-form material flow, in particular for cement plant construction, whose shuttle valve or shuttle valves is or are easy and inexpensive to repair or renew in case of wear and tear, a shuttle sluice is provided, whose shuttle valve has at least two parts and comprising of an upper suspension part and a lower expendable part, whereby the upper suspension part and the lower expendable part of the shuttle valve are stiff or rigid, i.e., detachably connected to each other, not hinged or pivoted to each other.

6 Claims, 2 Drawing Sheets

DEVICE FOR SLUICING A HOT MEAL-FORM MATERIAL

BACKGROUND OF THE INVENTION

The invention relates to a device for sluicing a hot meal-form material, in particular a hot flow of raw cement meal in the cyclone suspension type heat exchanger system of a plant for manufacturing cement clinkers out of raw meal, with a sluice case with upper material inlet, lower material outlet and at least one shuttle valve arranged between the two openings.

Plants for manufacturing cement clinkers out of raw cement meal in accordance with the dry process have a raw meal pre-heater, which as a rule consists of a cyclone suspension type heat exchanger system, into which the raw meal is loaded above, where it moves successively through the cyclone steps in the combined parallel flow/reverse flow to the hot exhaust gas of a pre-calcination step, to be separated from the hot exhaust gas in the lowest cyclone and fed into the feed chamber of the rotary kiln as high-grade pre-calcinated raw cement meal, in whose sintering zone it is burned into cement clinkers. The heated raw meal separated from the flow of exhaust gas in the individually stacked cyclone steps of the cyclone suspension type heat exchanger train is fed into the exhaust pipe section, or the pre-calcinated raw meal from the lowest cyclone step is fed into the rotary kiln feed chamber via vertical or diagonal meal gravity feed pipes or raw meal chutes under the influence of gravity. See for example U.S. Pat. No. 6,444,026, the disclosure of which is incorporated herein by reference.

So-called shuttle sluices or damper boxes, also double shuttle sluices, in which one or two weighted shuttle valves are integrated, are installed in the meal gravity feed pipes. The shuttle valves have the task of holding back the hot gas flow and allowing the hot raw meal flow down through the meal gravity feed pipe after a specific solid load by turning the valves up (Publication "Drehrohrofenanlagen" Rotary kiln plants>No. 8–100d of KHD Humboldt Wedag AG, 5–84, Pages 8/9). These shuttle valves are subject to great mechanical, chemical and thermal stress and with it, great high thermo-chemical and abrasive wear and tear. Up to now the shuttle valves have been constructed in one piece, i.e., in case of wear and tear the entire shuttle valve had to be removed and repaired or replaced with a new shuttle valve.

SUMMARY OF THE INVENTION

The invention is based on the task of creating a device like a shuttle sluice for sluicing or distributing a hot meal-shaped material flow, in particular for cement plants, whose shuttle valve or shuttle valves is or are easy and inexpensive to repair or renew in case of wear and tear.

Characteristic for the shuttle sluice of the invention is the fact that the shuttle valve in the sluice case is constructed not in one piece, but has at least two parts and in two-part design comprises an upper suspension part and a lower expendable part, in particular made of different materials. The upper suspension part, which can be made of a tough, heat-resistant material, and the lower expendable part of the shuttle valve, which consists preferably of a material resistant to heat and wear, are stiff or rigid, i.e., detachably connected to each other, not hinged or pivoted to each other. The size of the expendable part corresponds to that of the lower shuttle valve area, which comes into contact with the hot abrasive meal flow during the damming up and releasing of the periodically backed up flow of hot meal. The upper suspension part and the lower expendable part made of different materials can expand differently and therefore no thermal stresses occur. In case of wear and tear, the upper suspension part and the lower expendable part are simply disconnected and the expendable part is either repaired or replaced with a new part. From case to case, the materials of the two valve parts can be either the same or similar in design.

In the shuttle valve of the invention, the detachable connection between the upper suspension part and the lower expendable part can be designed like a stiff or stiffened joint. In accordance with a special feature of the invention, the upper suspension part and the lower expendable part of the shuttle valve can intermesh at their adjoining sides like a tongue and groove joint, whereby in the tooth area of the intermeshing valve parts two bolts, spaced at a distance from each other, parallel to the swiveling axis of the shuttle valve, are detachably guided through correspondingly aligned passages.

The upper suspension part of the shuttle valve can be composed of a casting, on whose upper side a journal of a shaft is integrally cast on both sides. The two journals of the upper suspension part then form the swiveling axis or full-floating axle of the weighted shuttle valve. The suspension part can also be designed as a weldment. The lower expendable part can be designed as a cast part, welded part or ceramic part.

In accordance with a further feature of the invention, at least the side of the shuttle valve that is subject to wear that is turned away from the material flow to be sluiced can be coated with a fireproof and wear-resistant material. For this purpose, the two parts of the shuttle valve, or at least the lower expendable part, can be designed as composite bodies, comprising of a flat metallic foundation, on which webs of a metallic trellised grate are arranged, whose openings are filled in with a heat-resistant ceramic substance. However, one or both valve parts can also be provided with a different wear-resistant protective coating on one or both surfaces.

The invention and its further features and advantages are illustrated by means of the practical examples schematically displayed in the figures.

DETAILED DESCRIPTION OF THE PREFERRED EMBODIMENTS

Figure 1:
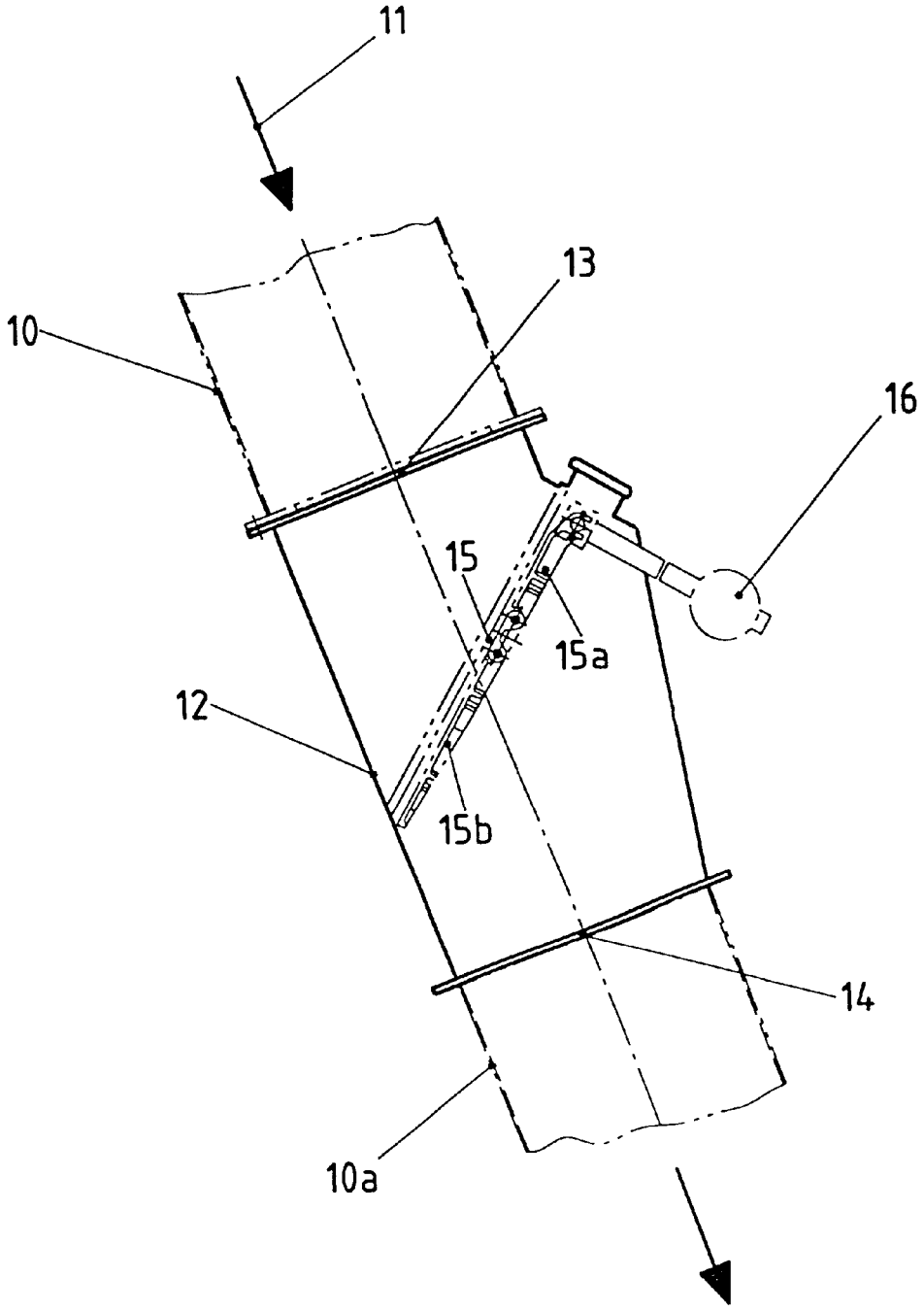
FIG. 1 illustrates a shuttle sluice installed in a diagonal raw meal chute or gravity feed pipe of a cyclone suspension type heat exchanger system for preheating of raw cement meal with an integrated weighted shuttle valve.

In accordance with FIG. 1, a shuttle sluice with a case 12 with an upper material inlet 13 and a lower material outlet 14 and with a shuttle valve 15 arranged between both openings, is installed in a diagonal raw meal chute or gravity feed pipe 10, through which under the influence of gravity a hot flow of raw meal 11 is conveyed from top to bottom. The shuttle valve is, as a result of a weight load 16, kept in a diagonal position, blocking the flow of raw meal 11. The shuttle sluice installed between the individual cyclone steps of the cyclone suspension type heat exchanger system of a cement clinker production line (see U.S. Pat. Nos. 6,444,026 and 6,000,937, the disclosures of which are incorporated herein by reference) with its weighted shuttle valve 15 has the task of, on the one hand, holding back the hot gas flow ascending from the bottom to the top and on the other hand, allowing the periodically backed up hot raw meal flow 11 down through a meal gravity feed pipe 10*a* after a specific solid load has accumulated by turning the shuttle valve 15.

Figure 2:
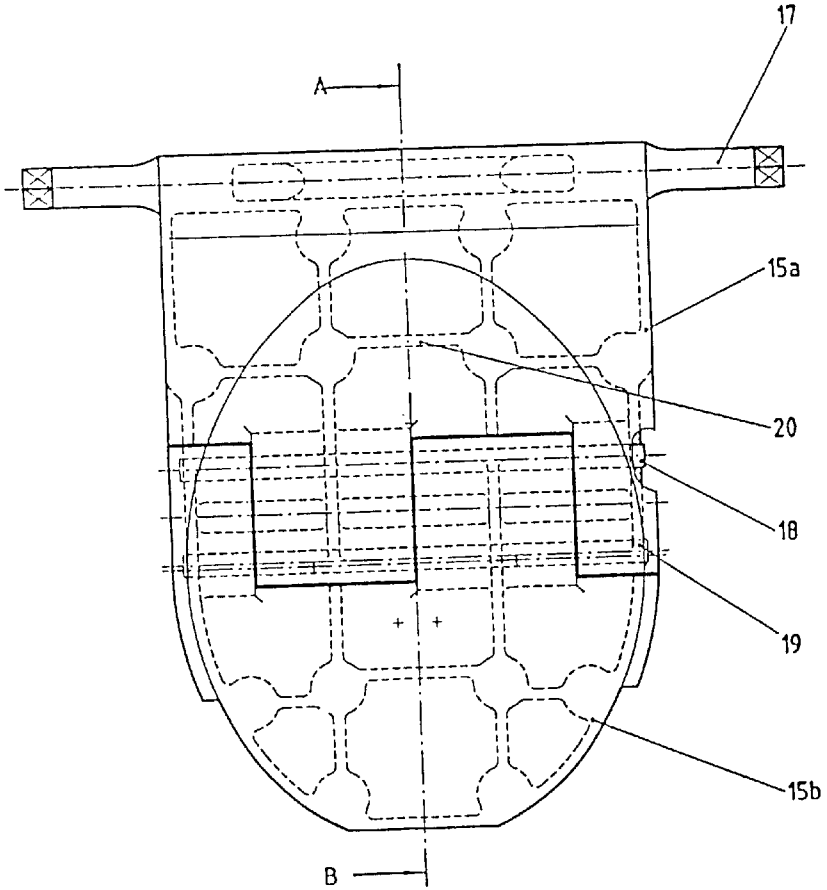
FIG. 2 illustrates the view and top view of the shuttle valve of FIG. 1.

According to the invention, the shuttle valve 15 has at least two parts comprising of an upper suspension part 15*a* and a lower expendable part 15*b*. As shown in particular in FIGS. 1 and 2, the upper suspension part 15*a* of the shuttle valve can be made of a tough heat-proof material, e.g., a casting on whose upper side a journal of a shaft 17 is integrally cast on both sides, so that the two journals 17 form the swiveling axis of the shuttle valve 15 in the valve case 12. The lower valve part 15*b* can be made of a wear-resistant, heat-proof material.

Upper suspension part 15*a* and lower expendable part 15*b* of the shuttle valve are stiff or rigid, i.e., detachably connected to each other, not hinged or pivoted to each other. For this purpose, in accordance with the practical example of FIG. 2, the upper suspension part 15*a* and the lower expendable part 15*b* of the shuttle valve intermesh at their adjoining sides like a tongue and groove joint, whereby in the tooth area of the intermeshing valve parts, two bolts 18 and 19, spaced at a distance from each other, parallel to the swiveling axis 17 of the shuttle valve, are detachably guided through correspondingly aligned internal passages. In the event of wear and tear on the shuttle valve, only the two bolts 18 and 19 are loosened and removed, and the lower expendable part 15*b* is removed and either repaired or replaced with a new expendable part.

The invention allows a strict separation of functions between valve suspension part 15*a* made of a tough heat-proof material and valve expendable part 15*b* made of a brittle and hard material and yet both valve parts are coupled without thermal stresses occurring.

Figure 3:
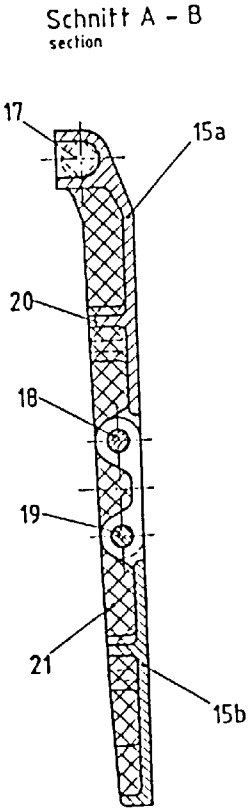
FIG. 3 illustrates the vertical section along line A–B of FIG. 2.

In accordance with a further feature of the invention, the side of the shuttle valve to be sluiced that is turned away from the material flow 11 in the conveyance direction can be coated with a fireproof and wear-resistant material. In this case the two parts 15*a* and 15*b* of the shuttle valve can be designed as composite bodies, comprising a flat metallic foundation, on which as reinforcement, webs 20 of a metallic trellised grate are arranged, whose openings are filled in with a heat-resistant ceramic substance 21 as best seen in FIG. 3.

The two shuttle valve parts can also be designed as hollow bodies permeated with coolant medium, so that an additional external cooling of the shuttle valve is made possible.

The invention is not only applicable for shuttle valves, but rather also for so-called impact sliders, which are installed in a hot gas conduit coming from the rotary kiln at cement plants and which, depending on the impact slider setting, have the task of either evenly distributing or suspending preheated raw cement meal that is fed into the hot gas conduit from the side.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A device for sluicing a hot meal-form material, with a sluice case having an upper material inlet, a lower material outlet and at least one shuttle valve arranged between the two openings and extending across a full width of the sluice case, comprising:

the shuttle valve having at least two parts and comprising an upper suspension part extending across a portion of, but less than the full width of the sluice case and a lower expendable part extending across a remaining portion of the width of the sluice case, and the upper suspension part and the lower expendable part of the shuttle valve are rigidly and detachably connected to each other, not hinged or pivoted to each other.

2. The device as set forth in claim 1, wherein the upper suspension part of the valve is made of a tough, heat-resistant material and the lower valve part comprises a material resistant to heat and wear.

3. A device for sluicing a hot meal-form material, with a sluice case having an upper material inlet, a lower material outlet and at least one shuttle valve arranged between the two openings, comprising:

the shuttle valve having at least two parts and comprising an upper suspension part and a lower expendable part, and the upper suspension part and the lower expendable part of the shuttle valve are rigidly and detachably connected to each other, not hinged or pivoted to each other, the upper suspension part and the lower expendable part of the shuttle valve intermesh at their adjoining sides like a tongue and groove joint, and in the tooth area of the intermeshing valve parts two bolts, spaced at a distance from each other, parallel to the swiveling axis of the shuttle valve, are detachably guided through correspondingly aligned internal passages.

4. The device as set forth in claim 1, wherein the upper suspension part of the shuttle valve is composed of a casting, on whose upper side a journal of a shaft is integrally cast on both lateral sides.

5. A device for sluicing a hot meal-form material, with a sluice case having an upper material inlet, a lower material outlet and at least one shuttle valve arranged between the two openings, comprising:

the shuttle valve having at least two parts and comprising an upper suspension part and a lower expendable part, and the upper suspension part and the lower expendable part of the shuttle valve are rigidly and detachably connected to each other, not hinged or pivoted to each other, at least the side of the shuttle valve to be sluiced that is turned away from the material flow in the conveyance direction is coated with a fireproof and wear-resistant material.

6. The device as set forth in claim 5, wherein the two parts of the shuttle valve are designed as composite bodies, comprising a flat metallic foundation on which webs of a metallic trellised grate are arranged, whose openings are filled in with a heat-resistant ceramic substance.

* * * * *